United States Patent [19]

Grinde

[11] Patent Number: 4,976,638

[45] Date of Patent: Dec. 11, 1990

[54] SURFACE DRIVE FOR MARINE CRAFT HAVING INBOARD ENGINE

[75] Inventor: James E. Grinde, Anoka, Minn.

[73] Assignee: Yamaha Hatsudoki Kabushiki Kaisha, Iwata, Japan

[21] Appl. No.: 183,772

[22] Filed: Apr. 20, 1988

[30] Foreign Application Priority Data

Apr. 24, 1987 [JP] Japan ..... 62-99975

[51] Int. Cl.[5] ..... B63H 5/12

[52] U.S. Cl. ..... 440/57; 440/61; 440/83; 464/15; 464/145

[58] Field of Search ..... 440/83, 61, 75, 88, 440/89, 57; 464/145, 143, 141, 15, 7

[56] References Cited

U.S. PATENT DOCUMENTS

| | | | |
|---|---|---|---|
| 2,718,380 | 9/1955 | Muller | 464/145 |
| 2,875,599 | 3/1959 | Gregory | 464/145 |
| 3,976,027 | 8/1976 | Jones, Sr. | 440/61 |
| 4,178,873 | 12/1979 | Bankstahl | 440/89 |
| 4,504,238 | 3/1985 | Neisen | 440/89 |
| 4,544,362 | 10/1985 | Arneson | 440/61 |
| 4,726,796 | 2/1988 | Rivette, Jr. et al. | 440/57 |

FOREIGN PATENT DOCUMENTS

| | | | |
|---|---|---|---|
| 6367 | of 1885 | United Kingdom | 440/57 |

*Primary Examiner*—Sherman Basinger

*Attorney, Agent, or Firm*—Orrin M. Haugen; Thomas J. Nikolai; Frederick W. Niebuhr

[57] ABSTRACT

An improved surface drive for a marine craft having an inboard engine in which propeller generated thrust forces are transferred directly and co-linearly from the propeller shaft, through a constant velocity U-joint to the engine or transmission shaft to thereby reduce the overall dimensions of the surface drive unit.

6 Claims, 2 Drawing Sheets

SURFACE DRIVE FOR MARINE CRAFT HAVING INBOARD ENGINE

BACKGROUND OF THE INVENTION

I. Field of the Invention:

This invention relates generally to a drive system for a marine craft, and more particularly to an improved surface drive for a marine craft incorporating an inboard engine for powering the craft.

II. Discussion of the Prior Art:

Various arrangements are known in the art for providing motive power to a boat. For smaller crafts, the most common source of motive power is the outboard motor. It generally comprises a portable, unitary structure including a power head incorporating an internal combustion engine having a drive shaft extending vertically downward within an exhaust gas housing and leading to a lower unit comprising a transmission gear mechanism for coupling the engine's vertical drive shaft to a horizontal propeller shaft. This unitary assembly is suspended from the boat's transom such that the propeller mounted on the propeller shaft is totally submerged to a depth which is below the boat's keel.

For boats of a somewhat larger size, one or more engines, each including anywhere from four to eight cylinders, will be physically located within the boat's hull. The engines' shafts extends through the transom to individual outdrive units. Such outdrive units will each comprise a vertical shaft having a pinion gear on opposed ends thereof, the upper pinion gear cooperating with a bevel gear driven by the engine shaft and the lower pinion gear being arranged to mate with either a forward or a reverse bevel gear affixed to a horizontally disposed propeller shaft. The above-mentioned parts comprising the outdrive are generally contained within a casing which extends downward into the water such that the propeller will be totally submerged. Hydraulic cylinders are provided for pivoting the outdrive between a raised and lowered position to permit the attitude of the boat to be trimmed and to properly compensate for the passenger load. Moreover, means are provided for steering the craft by pivoting the outdrive about a vertical axis.

A third type of drive system is termed an "inboard" and here, both the engine(s) and the transmission(s) are contained within the hull and only the propeller shaft extends outward through the transom or through the bottom of the boat. With this type of drive, steering is generally accomplished by a separate rudder rather than by redirecting the orientation of the propeller shaft.

All three of the above conventional drive systems for marine craft exhibit a reduced efficiency due to "appendage drag". That is to say, these drives each involve an appendage, i.e., the lower unit portion of the outboard or outdrive which is immersed in the water and at a level beneath the craft's hull. Dragging this appendage through the water necessarily detracts from the forward speed of the craft.

A somewhat recent innovation in marine craft drive systems is the so-called surface drive described in the Arneson U.S. Pat. No. 4,544,362 and the Adams et al U.S. Pat. No. 3,933,116. In these arrangements, the propeller shaft is brought out through the transom or the outdrive is arranged such that it assumes a generally horizontal orientation just at the waterline such that only one-half of the propeller hub is submerged. The prop shaft and its housing are driven through a universal joint coupling the engine shaft to the propeller shaft and allowing the propeller shaft to be pivoted, as by a suitable hydraulic actuator, in both a horizontal and a vertical plane. This arrangement cuts down significantly on the appendage drag in that approximately only one-half of the prop shaft extension housing is submerged and it will generally be projecting rearward from the transom at a level above the bottom or keel of the craft.

The Arneson patent also discloses the use of a constant velocity universal joint for rotationally coupling the engine's or transmission's shaft to the propeller shaft and to the prop shaft extension housing. Such a constant velocity U-joint generally comprises an outer race having spherical grooves formed in its inner surface and an inner race in the form of a ball or sphere also having spherical grooves formed in its exterior surface. A plurality of drive balls are disposed in an annular cage and have a radius corresponding to the radius of the spherical grooves formed in the inner and outer races so that the drive balls can fit within the respective grooves. The engine shaft or transmission shaft is coupled to the inner race so as to impart rotational forces to it. These forces are then transmitted through the drive balls to the inner race. The outer race is, in turn, coupled to the propeller shaft. By providing this mechanism, the rotational forces can be applied to the propeller at the same time that the prop shaft can be pivoted vertically and laterally relative to the engine shaft.

With the constant velocity U-joint shown in the Arneson patent, all of the forward thrust forces developed by the propeller must be transferred through a spherical housing surrounding the outer race of the constant velocity U-joint and from there through a tubular support casing directly to the boat's transom. In that these thrust forces are quite substantial, it dictates that these structures be sufficiently large to surround the U-joint and strong enough to carry the prop thrust forces. This adds to the appendage drag presented by the drive assembly.

As is further set out in the Arneson patent, in a surface drive it is desirable that the ball socket surrounding the U-joint be disposed as low as possible on the boat transom with the propeller shaft maintained in close longitudinal alignment with the drive shaft during normal forward travel of the boat. This causes the line of propeller thrust to be maintained low relative to the boat and below the boat's center of gravity. The ability to position the tubular ball socket low on the transom is dependent upon the size of the ball socket itself and, hence, if a U-joint of lesser dimension can be employed, the size of the ball socket surrounding the U-joint can be reduced.

Another feature of the Arneson drive is that the exhaust manifolds and exhaust pipes for the engine are located above the water line and pass through the boat's transom. As such, engine exhaust noise tends to be excessive. The noise can be reduced if the exhaust gases and engine cooling water are allowed to exit through the propeller extension housing.

SUMMARY OF THE INVENTION

The present invention provides an improved surface drive arrangement for an inboard or inboard/outboard style marine craft wherein the applied thrust angle is more nearly horizontal and exhaust silencing characteristics are improved as compared to the configurations disclosed in the aforereferenced Arneson Patent. Rather than transmitting the propeller thrust forces from the prop shaft to the transom through a ball socket, the thrust forces are instead transmitted directly and co-linearly through a constant velocity U-joint from the propeller shaft to the engine/transmission shaft. As such, a constant velocity U-joint of a smaller overall dimension may be employed whereby it may be housed in a casing of lesser transverse dimension, all this without sacrificing performance life of the surface drive.

To achieve the shaft-to-shaft propeller thrust transmission, there is affixed to the inner end of the propeller shaft a thrust ball having a spherical arcuate surface of a radius so that it lies on the same circular locus as is occupied by the center of the drive balls forming part of the constant velocity U-joint itself. Attached to the mating end of the transmission or engine shaft and, thus, to the outer race of the constant velocity U-joint, is a thrust socket also having a concave spherical surface corresponding in curvature to that of the thrust ball. Thus, the thrust ball can fit into the thrust socket for transferring axial thrust forces from the prop shaft directly to the engine or transmission shaft. This ball and socket arrangement further permits these thrust forces to be transmitted while the prop shaft is pivoted either vertically or sideways in steering the craft or in adjusting the attitude of the boat during a trimming operation. A special lubricating system is provided for reducing the friction between the thrust ball and thrust socket.

The smaller diameter universal joint allowed by the present invention offers a further advantage in permitting the drive shaft or engine shaft to exit the transom of the craft at a lower point in the stern and in a generally horizontal attitude. As is pointed out in the Arneson patent, there is a desirable attribute of a surface drive propelling system.

Moreover, exhaust gases, heated engine cooling water and sound energy are made to exit the engine's exhaust manifold through a flexible tubular coupling leading to the prop shaft extension housing and from there, through the propeller hub and into the water. This leads to quieter operation and better consumer acceptance and satisfaction.

OBJECTS

It is accordingly a principal object of the present invention to provide an improved surface drive for use with marine craft having inboard engines.

Another object of the invention is to provide a surface drive for a marine craft in which propeller thrust forces are transferred directly from the propeller shaft through a constant velocity U-joint to the engine/transmission shaft rather than through a ball joint surrounding the constant velocity U-joint.

Yet another object of the invention is to provide a surface drive for a marine craft which can be physically placed at a lower point on the transom than known prior art surface drives.

A still further object of the invention is to provide a surface drive incorporating a through-the-hub exhaust and cooling water discharge.

These and other advantages and features of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
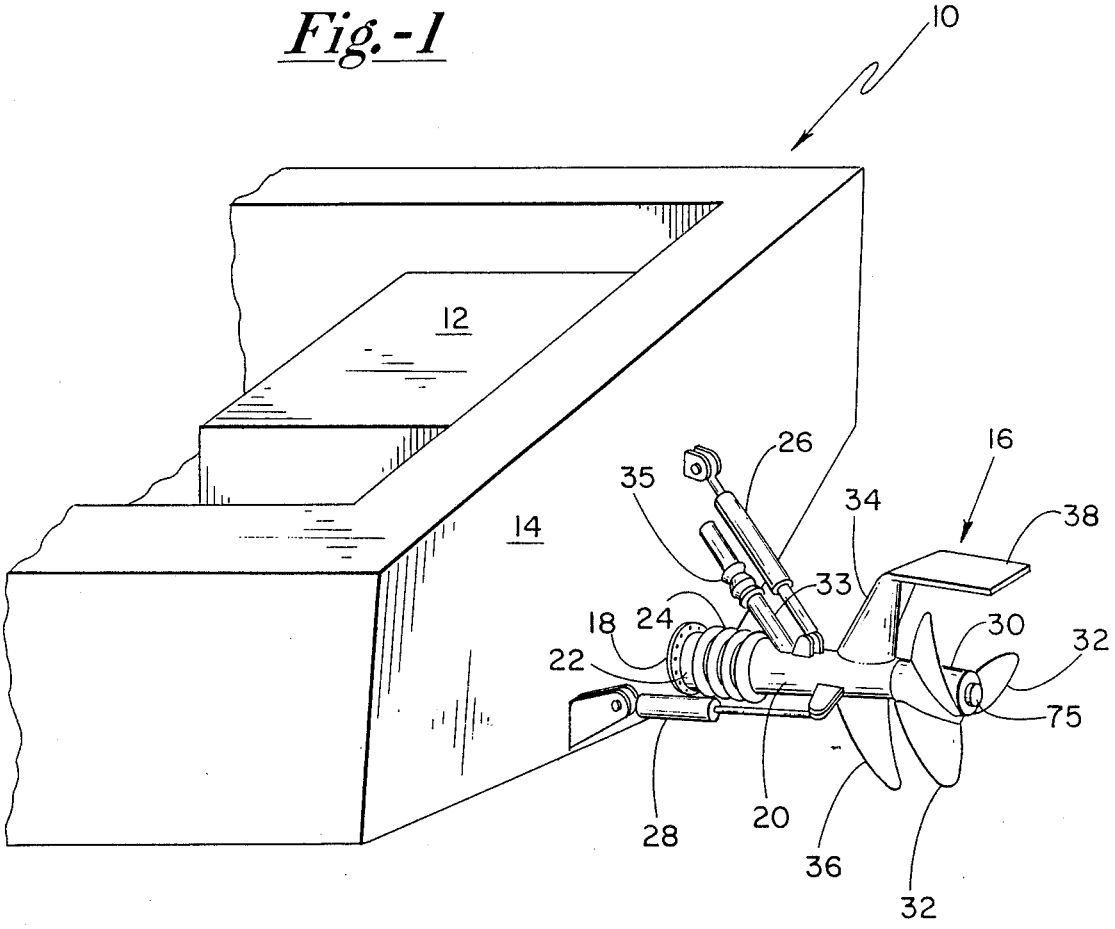
FIG. 1 is a partial perspective view of a marine craft embodying the improved surface drive of the present invention.

Referring to FIG. 1, the aft portion of a marine craft is illustrated and identified generally by numeral 10. Fully contained within the hull of the craft is an internal combustion engine (not shown) which is housed within an engine box or housing 12 just forward of the transom 14. Extending outwardly from the transom 14 is a surface drive assembly, here indicated generally by numeral 16. It is secured to the transom just above the boat's keel by a flange plate 18 which is secured to the transom by suitable bolts.

The surface drive assembly 16 includes a prop shaft extension housing 20 which, as will be described fully hereinbelow, is pivotally joined to the transmission shaft housing 22 by a constant velocity U-joint assembly. This U-joint is obscured from view in FIG. 1 by an accordian-pleated, flexible, elastomeric boot or sleeve 24. A first linear actuator 26 is coupled between the boat's transom and the prop shaft extension housing 20 for pivoting the prop shaft extension housing 20 in a vertical plane. Likewise, a second linear actuator 28 is coupled between the transom 14 and the prop shaft extension housing 20 for effecting movement of the prop shaft extension housing back and forth in a generally horizontal plane. The linear actuators may comprise hydraulic cylinders with actuator 26 controlling the tilt angle of the prop shaft and linear actuator 28 imparting steering motion to the craft. Other forms of linear actuators are known in the art.

Secured by a splined coupling and a nut to the end of the prop shaft is the propeller itself which comprises a hub member 30 and a plurality of radially extending blades 32.

An exhaust/cooling water line 33 passes through the transom and connectors to the housing 20 and includes a flexible segment, as at 35, to accommodate the pivoting and steering movements imparted to the prop shaft extension housing 20 by the linear actuators.

Projecting both upwardly and downwardly from the prop shaft extension housing 20 and lying in a generally vertical plane are stabilizing fins 34 and 36. A splash plate 38 is integrally formed with the upper stabilizing fin 34 and extends rearward so as to overlay the propeller. This splash plate tends to reduce the rooster-tail spray given off by the propeller of a surface drive.

Having described the general arrangement of the surface drive of the present invention, consideration will next be given to the mechanical design of the drive and, in this regard, reference will be made to the cross-sectional view of FIG. 2, and the enlarged view of FIG. 3.

The bearing retainer flange plate 18 attached to the transom is formed integrally with bearing housing 22 and receives the engine/transmission output shaft 42 therethrough. Shaft oil seals 44 are contained within the bearing retainer plate 18 for blocking the flow of lubricating oil therebeyond. The engine/transmission shaft 42 is journaled for rotation in a pair of back-to-back tapered roller bearing assemblies 46 and 48 which are disposed in a bearing retainer 50. O-ring seals, as at 52 and 54, isolate the oil-filled bearing retainer 50 from the engine cooling water passage, the details of which will now be explained.

Disposed on the underside of the bearing housing 22 is a downwardly extending scoop 56 having a water inlet port 58 formed therethrough. This port leads to an annular chamber 60 surrounding the bearing retainer 50. Also communicating with the annular chamber 60 is a tubular passage 62. It is arranged to project through the boat's transom 14 and is coupled by suitable hosing to the engine's water pump inlet (not shown). The intake port 58 is below the water line and is continuously submerged, insuring a supply of flotation water to the engine for cooling purposes.

As in the Arneson patent, rotational forces are delivered to the propeller shaft 64 through a constant velocity U-joint 66. The details of construction of this U-joint are more clearly illustrated in the enlarged view of FIG. 3. As is shown there, the engine/transmission output shaft 42 is coupled to the propeller extension shaft 64 by means of a constant velocity U-joint such as of the type manufactured by the Con-Vel Plant of the Dana Corporation of Detroit, Michigan. This U-joint is indicated generally in FIG. 3 by numeral 66 and includes a drive collar 68 which is fastened to the shaft 42 by a splined-connection on the shaft and a nut 70 screwed onto a threaded rod **42*a* extending from the end of the engine/-transmission shaft 42. The drive collar is journaled for rotation within the bearing retainer 50 by bearings 72. The drive collar 68 is welded to an adapter ring 74 as shown at 76 and a series of bolts, as at 78, are used to secure the outer race member 80 of the constant velocity U-joint 66 to the adapter ring 74. The inner surface of the outer race 80 is provided with a plurality of spherical grooves 82 for receiving a corresponding plurality of spherical drive balls 84 which are held in place by means of an annular ball cage 86. The constant velocity U-joint also includes an inner race which comprises a segment of a sphere of a predetermined radius. Formed in the surface of the sphere 88 are spherical grooves dimensioned to also receive the drive balls 84 therein. The inner race 88 is splined to the prop shaft 64 and, thus, the rotational force imparted by the transmission shaft 42 to the outer race 80, via the drive collar 68 and the adapter ring 74, is transmitted to the propeller shaft 64 by the drive balls 84**.

The prop shaft 64 is journaled for rotation within the prop shaft extension housing 20. Specifically, contained within the prop shaft extension housing 20 are bearing supports 65 and 67 which contain bearing assemblies 69 and 71 which are, in turn, sandwiched between shaft seals 73. The surface drive propeller 30–32 is secured to the end of the prop shaft 64 by a threaded nut 75.

Figure 3:
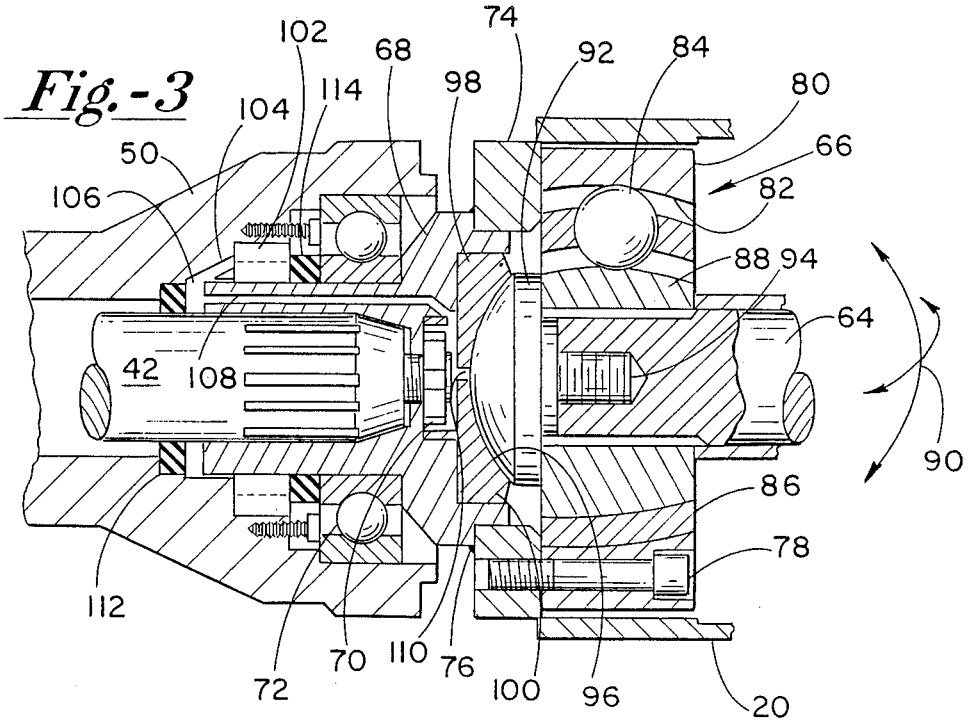
FIG. 3 is an enlarged cross-sectional view of the constant velocity U-joint illustrated in FIG. 2.

The shaft 64 is able to pivot relative to the shaft 42, allowing the linear actuators 26 and 28 to impart tilt and steering movements to the prop shaft extension housing 20 as indicated by the doubled headed arrows 90 shown in FIG. 3.

An important aspect of the present invention is that the thrust forces developed by the propeller 32 and imparted to the propeller shaft 64 are transferred directly and colinearly to the engine/transmission shaft 42, rather than indirectly through the prop shaft extension housing 20 and the bearing housing 22 as in the Arneson surface drive described in U.S. Pat. No. 4,544,362. To achieve this direct, co-linearly thrust-force transfer, a thrust ball member 92 is fastened to the prop shaft 64 by a threaded stud 94 while the spherical surface thereof 96 cooperates with a mating spherical concave recess formed in a thrust socket member 98.

As illustrated in FIG. 3, the thrust socket 98 fits within a cylindrical bore 100 of the drive collar 68 and includes an annular flange cooperating with a splined nut 70 which is used to hold the drive collar 68 onto the engine/transmission shaft 42. The curved surface of thrust ball 92 is designed to lie on the same radius as the centers of the drive balls 84 and, as such, any tilt and steering motion imparted to the prop shaft extension housing 20 results in intimate ball-socket engagement and a direct transfer of the propeller thrust from the propeller drive shaft 64 through the thrust ball 92, the thrust ball socket 98 to the engine/transmission shaft 42. Because the thrust forces are accommodated in the fashion indicated, there is no need to provide substantial bulk in the constant velocity U-joint members 66, 68 and 74. Hence, the prop shaft extension housing 20 and the bearing housing 22 can be of a reduced diameter when compared to what would otherwise be required if the thrust forces of the propeller were to be transferred through the prop shaft extension housing and a support casing as in the Arneson patent. This smaller diameter housing structure 20–22 allows the surface drive unit to be mounted lower on the transom of the boat than would otherwise be permitted. As such, the applied thrust angle can be made to approach the horizontal so that the bow-down moment of the thrust force is minimized. When the boat is on plane, then, a smaller portion of the boat hull is in contact with the water surface, lessening the hull drag.

To maintain the thrust ball 92 and the thrust socket 96 interface adequately lubricated, a gearotor type oil pump 102 surrounds the collar 68 and the inner gear thereof is driven by the rotating collar 68 to collect oil from the sump space occupied by the bearings 72 and to deliver it under pressure through passageways 104, 106, 108 and 110 to the interface between the thrust ball 92 and the thrust socket 98. The oil seals 112 and 114 are included to prevent leakage of the pressurized oil beyond these passageways.

Figure 2:
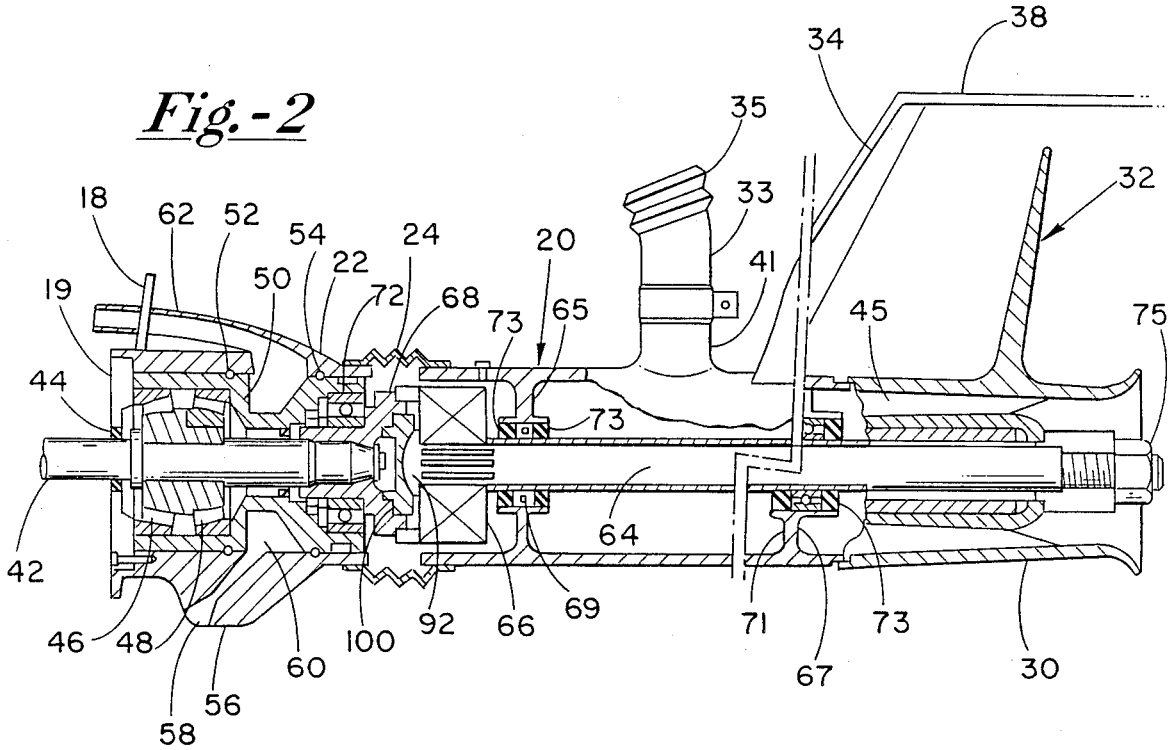
FIG. 2 is a longitudinal cross-sectional view taken through the center of the surface drive assembly of FIG. 1.

With reference to FIG. 2, an exhaust cooling water discharge port 41 is formed through the propeller extension housing 20 and is coupled to the exhaust pipe 33 which extends through the transom 14 where it is coupled by means, not shown, to the exhaust gas manifold of the engine. A length of flexible hosing 35 is used to join the two together such that exhaust gases from the internal combustion engine and cooling water discharged therefrom pass through the flexible tube 35 and through ports 45 formed through the propeller hub 30. Alternately, the exhaust can be discharged over the propeller hub as is well known in the industry. In this fashion, exhaust fumes, noise and cooling water are discharged through the propeller extension housing, rather than through the transom above the water line adding considerably to engine exhaust noise suppression.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a surface drive for a marine craft having an inboard engine and a hull including a transom, said surface drive being of the type having a bearing housing attached exteriorly of said transom and extending rearwardly therefrom, said bearing housing including bearing means for journaling an engine or transmission shaft therein, a propeller shaft extension housing coupled to said bearing housing and extending rearwardly therefrom, a propeller shaft journaled for rotation within said propeller shaft extension housing and a constant velocity universal joint coupled between said engine or transmission shaft and said propeller shaft for transferring rotational forces from said engine or transmission shaft to said propeller shaft while allowing said propeller shaft extension housing to be pivoted relative to said bearing housing when trimming and steering said marine craft, the improvement comprising:

(a) means coupling said engine or transmission shaft to said universal joint for transferring propeller thrust forces directly and colinearly from said propeller shaft to said engine or transmission shaft as said propeller shaft extension housing is pivoted relative to said bearing housing.

2. The surface drive as in claim 1 wherein said means for transferring propeller thrust forces comprises:

(a) a thrust ball member of a predetermined radius attached to the forward end of said propeller shaft and a thrust socket member having a spherical concave recess therein of a radius corresponding to said predetermined radius, said thrust socket being rotatable with said engine or transmission shaft and receiving said thrust ball member within said recess.

3. The surface drive as in claim 1 wherein said universal joint comprises:

(a) an outer race member affixed to said engine or transmission shaft, said outer race member including a plurality of arcuate grooves of circular cross-section formed therein;

(b) an inner race member affixed to said propeller shaft, said inner race member having a spherical exterior surface, said spherical exterior surface including a corresponding plurality of arcuate grooves of circular cross-section;

(c) a corresponding plurality of drive ball members disposed, one each, in mating ones of said arcuate grooves formed in said inner and outer race members and wherein said outer race member is coupled to said engine or transmission shaft and said inner race member is coupled to said propeller shaft;

(d) a thrust ball member affixed to the forward end of said propeller shaft and having a spherical radius of curvature whose center is coincident with the centers of said drive ball members when said drive ball members are disposed in said mating ones of said arcuate groves; and (e) a thrust socket member coupled to and rotatable with said outer race member, said thrust socket member having a spherical recess dimensioned for receiving said thrust ball member therein with a predetermined clearance fit.

4. The surface drive as in claim 3 and further including pump means driven by said engine or transmission shaft for injecting lubricating oil under pressure into the interface between said thrust ball member and said thrust socket member.

5. The surface drive as in claim 4 wherein said pump means comprises:

(a) an oil reservoir;

(b) a gearotor pump driven by said engine or transmission shaft and having a pump inlet in fluid communication with said oil reservoir and a pump outlet coupled to a passageway leading to said interface.

6. The surface drive as in claim 1 and further including:

(a) a propeller mounted on said propeller shaft, said propeller including a hub and radiating blades projecting therefrom;

(b) means for routing engine exhaust gases and engine cooling water through said transom and into said propeller shaft extension housing; and (c) a passageway in said propeller shaft extension housing for conveying said exhaust gases and cooling water through said hub.

* * * * *